US006854196B2

(12) United States Patent
Burrell et al.

(10) Patent No.: US 6,854,196 B2
(45) Date of Patent: Feb. 15, 2005

(54) ADJUSTABLE BALUSTER SPACER TOOL

(75) Inventors: Terry D. Burrell, Dover, OH (US); Daniel L. Moore, New Philadelphia, OH (US)

(73) Assignee: L. J. Smith, Inc., Bowerston, OH (US)

( * ) Notice: Subject to any disclaimer, the term of this patent is extended or adjusted under 35 U.S.C. 154(b) by 0 days.

(21) Appl. No.: 10/453,029

(22) Filed: Jun. 3, 2003

(65) Prior Publication Data

US 2004/0244213 A1 Dec. 9, 2004

(51) Int. Cl.[7] ..... G01B 5/00

(52) U.S. Cl. ..... 33/558.02; 33/558.2; 33/645; 33/613; 33/23.01; 33/23.04

(58) Field of Search ..... 33/41.1, 558.01, 33/558.02, 558.2, 613, 645, 23.01, 23.04, 23.06, 23.08

(56) References Cited

U.S. PATENT DOCUMENTS

| | | | | | |
|---|---|---|---|---|---|
| 829,938 | A | * | 8/1906 | Cote | 33/558.02 |
| 861,417 | A | * | 7/1907 | Woodward | 33/23.01 |
| 967,267 | A | * | 8/1910 | Thompson | 33/558.02 |
| 1,327,874 | A | * | 1/1920 | Mathews | 33/41.1 |
| 1,428,582 | A | * | 9/1922 | Deitz | 33/41.1 |
| 1,696,832 | A | * | 12/1928 | Bane | 33/558.02 |
| 2,527,019 | A | * | 10/1950 | Marbury, Jr. | 33/41.1 |
| 2,883,759 | A | * | 4/1959 | Milton et al. | 33/645 |
| 3,157,953 | A | * | 11/1964 | Hyman | 33/558.02 |
| 4,390,491 | A | * | 6/1983 | Woodall | 33/23.08 |
| 4,397,090 | A | * | 8/1983 | Nicyper | 33/23.04 |
| 4,936,022 | A | * | 6/1990 | Grayzel | 33/558.02 |
| 6,293,028 | B1 | * | 9/2001 | Sylvia | 33/613 |
| 6,427,348 | B1 | * | 8/2002 | Webb | 33/286 |

FOREIGN PATENT DOCUMENTS

| | | | | |
|---|---|---|---|---|
| DE | 3600616 C1 | * | 11/1986 | B43L/13/10 |
| GB | 2085810 A | * | 5/1982 | B43L/9/08 |

* cited by examiner

*Primary Examiner*—Diego Gutierrez
*Assistant Examiner*—Travis Reis
(74) *Attorney, Agent, or Firm*—Sand & Sebolt

(57) ABSTRACT

An adjustable spacer tool for spacing balusters includes an extendable pantograpic assembly having a first and second end and including evenly-spaced parallel uprights and X-shaped sets of cross-bars pivotally connected to one another. Each X-shaped set is pivotally connected to a pair of uprights adjacent upper ends thereof and pivotally and slidably connected to the uprights adjacent lower ends thereof. An arm, finger and cam extend outwardly from each end of the assembly to provide spacing between each end of the assembly and a desired surface for various sets of same-width balusters. Each arm is pivotally connected to one end of the assembly and to one end of the finger. The other end of the finger is pivotally and slidably connected to a respective end of the assembly. Each cam is pivotally connected to the arm distal the assembly. Removable connections permit adjustment of the overall length of the tool and replacement of parts.

51 Claims, 15 Drawing Sheets

ADJUSTABLE BALUSTER SPACER TOOL

BACKGROUND OF THE INVENTION

1. Technical Field

The invention relates generally to spacer tools used to measure the proper spacing between balusters in the installation thereof. More particularly, the invention relates to spacer tools with adjustable spacing capabilities. Specifically, the invention relates to an adjustable spacer tool that allows for adjustment of overall tool length and that allows for proper spacing between adjacent balusters and between a wall or other surface and a baluster which is to be installed adjacent the wall.

2. Background Information

Spacer tools for measuring the distance between balusters, such as used in the installation of stairways for the support of handrails, are known in the art. However, several problems still exist. First, such spacers have set overall lengths and thus can only be used for that length, or alternately for longer distances by moving the spacer tool to overlap an area already measured. Since it is often desired to install balusters along a distance different (especially shorter) than the length of a given spacer tool, known spacer tools cannot effectively be used for shorter distances. This requires a plurality of tools having different lengths, which can be inconvenient, bulky and costly. Further, while establishing consistent spacing between the various guides of a spacer tool is known, establishing the spacing between the end guides and a wall or other vertical surface is a problem in the art. An additional problem is establishing the end spacing for a set of same-width balusters having a given width and subsequently establishing the end spacing for another set of same-width balusters having a different width.

BRIEF SUMMARY OF THE INVENTION

The spacer tool of the present invention provides an extendable and retractable pantographic assembly having a first end and a second end; an arm projecting from and pivotally connected to one end of the assembly; and a finger pivotally connected to the arm at an intermediate point thereof and pivotally and slidably connected to the one end of the assembly.

The spacer tool of the present invention further provides an extendable and retractable pantographic assembly having a first end and a second end; an arm having a first end, a second end, a first pivot axis adjacent the first end of the arm, a second pivot axis adjacent the second end of the arm and an intermediate pivot axis intermediate the first and second pivot axes; the arm pivotally connected about the first pivot axis to one end of the assembly; the first, second and intermediate axes defining a triangle; and a finger pivotally connected to the arm at the intermediate axis thereof and pivotally and slidably connected to the one end of the assembly.

The spacer tool of the present invention also provides an extendable and retractable pantographic assembly including a plurality of parallel uprights and at least one X-shaped set of cross-bars; each set comprising a pair of cross-bars being pivotally and medially connected to one another; each set having a first side and a second side connected to respective uprights; one side being removably connected to the respective upright.

BRIEF DESCRIPTION OF THE DRAWINGS

Similar numerals refer to similar parts throughout the drawings.

DETAILED DESCRIPTION OF THE INVENTION

Figure 1:
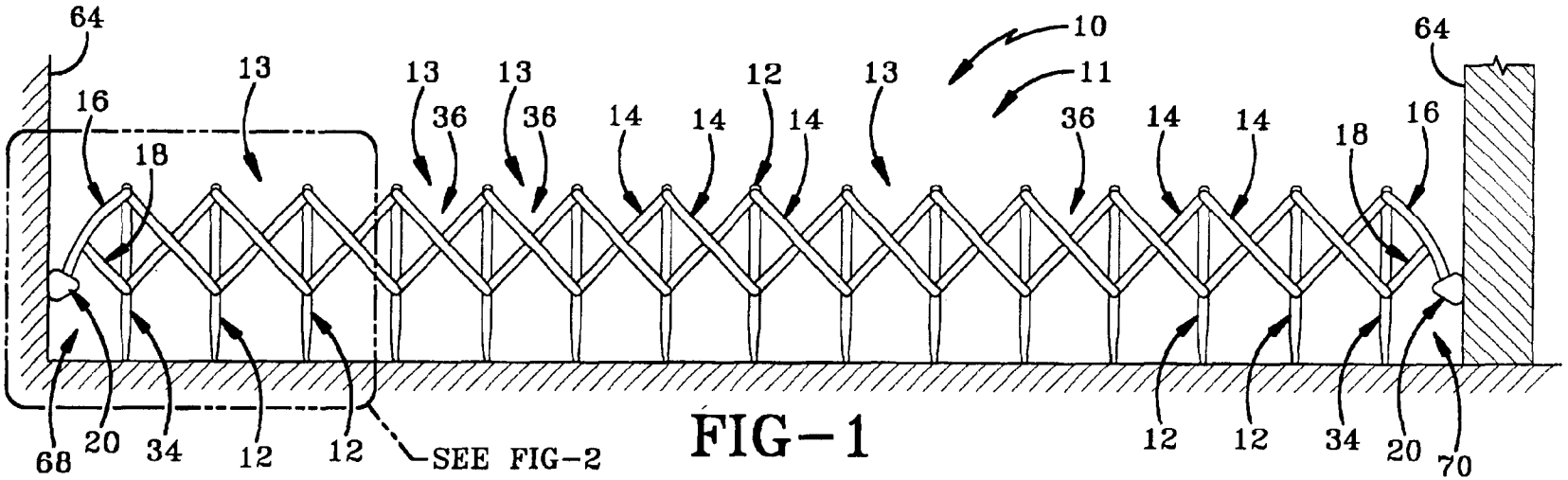
FIG. 1 is a side elevational view of the spacer tool of the present invention in the full-length configuration.
Figure 12:
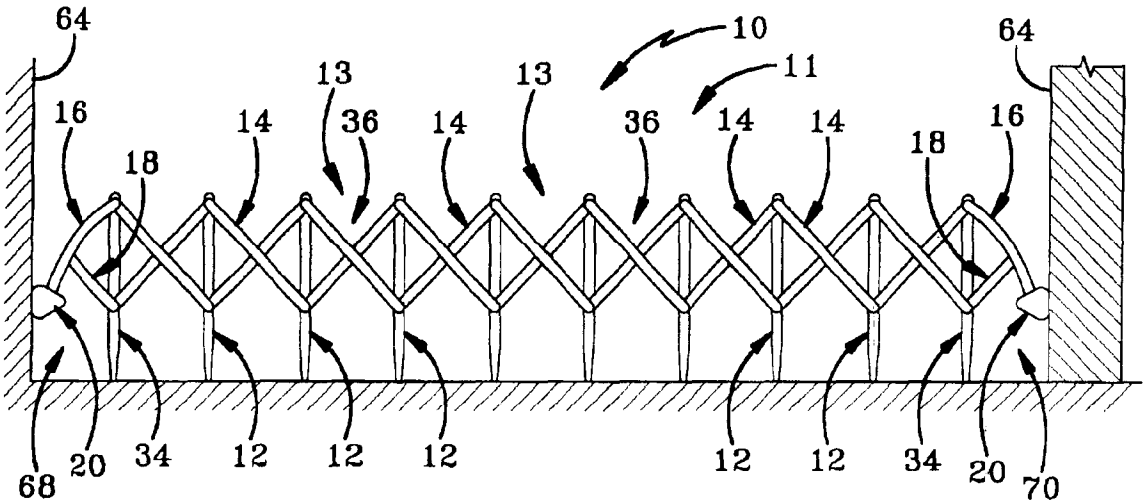
FIG. 12 is a side elevational view of the spacer tool in a reduced-length configuration.
Figure 2:
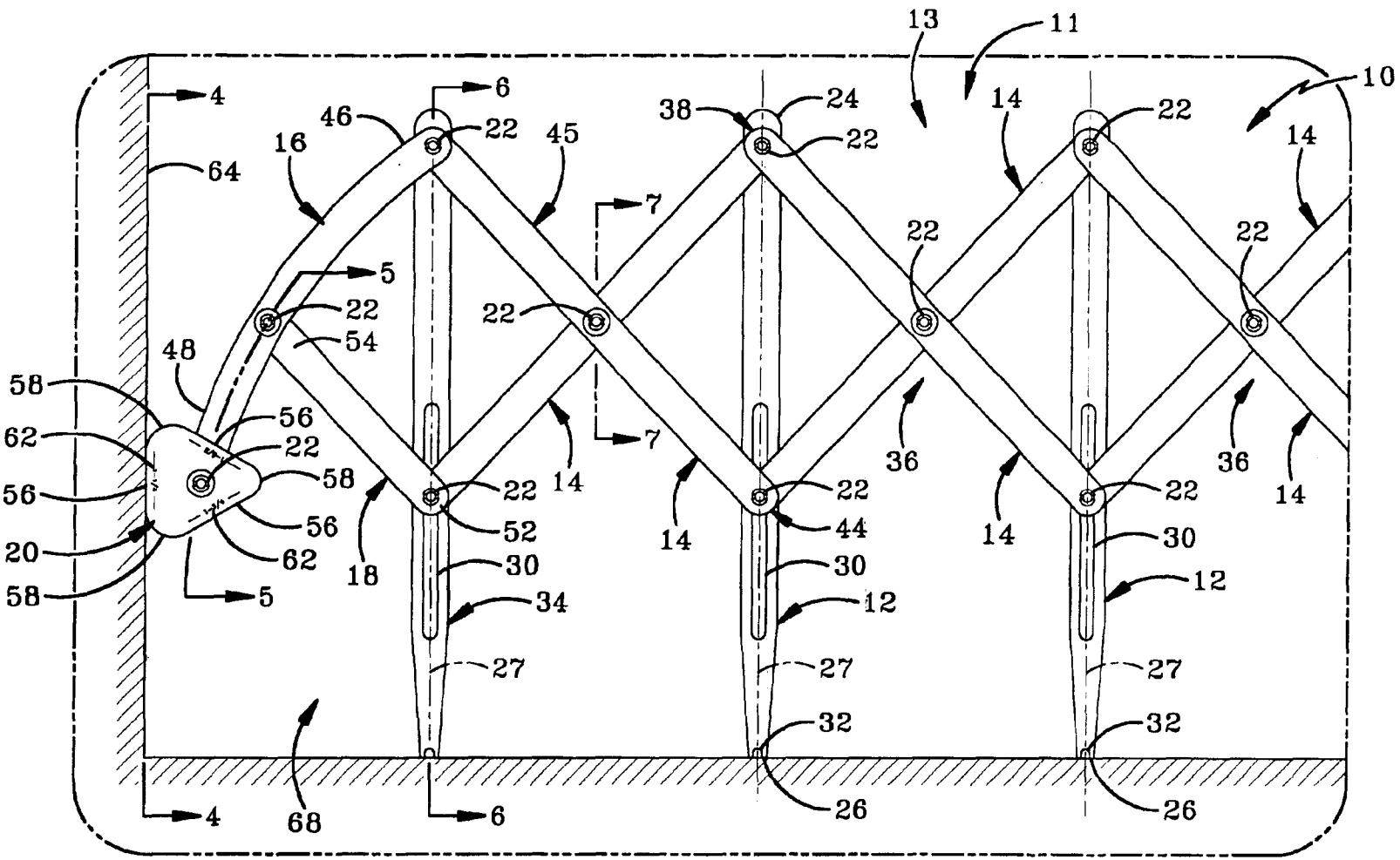
FIG. 2 is an enlarged view of the circumscribed portion of FIG. 1.

The spacer tool of the present invention is indicated generally by the numeral 10 in the drawings. Tool 10 generally includes a pantographic assembly 11 with an arm 16 extending from at least one end of assembly 11. Arm 16 is supported by a finger 18 that extends intermediate arm 16 and assembly 11. Assembly 11 includes at least one extendable and retractable pantograph unit 13. Each unit 13 includes two uprights 12 or 34 and two cross bars 14. A cam 20 may also be connected to arm 16. Fasteners, such as a plurality of push rivets 22 or bolts, removably connect these various parts to one another. Tool 10 has a first end 68 and a second end 70.

Tool 10 is used to lay out the spacing for balusters by placing the free end of arm 16 against a wall and extending assembly 11 to fit the desired length for the balusters. The user then marks the baluster location at the bottom of each upright. In accordance with the invention, arm 16 correctly spaces the first baluster from the wall.

The fasteners may, in various combinations, also be formed integrally with uprights 12, 34, cross-bars 14, arms 16, fingers 18 or cams 20, and may or may not allow a removable connection between these various parts. Such integrally formed fasteners may be, for example, outwardly extending posts. Many of push rivets 22 are also interchangeable, although they vary in length, depending on whether they must pass through two, three or four parts of tool 10 that they connect (FIGS. 4–7).

All uprights, which include interior uprights 12 and terminal uprights 34, are parallel with one another and substantially coplanar and tool 10 generally lies along a plane, although tool 10 may be manipulated to have a degree of curvature as viewed from above. All uprights 12, 34 are substantially rigid and are interchangeable with one another. Each upright 12, 34 has a top end 24, a bottom end 26 and a central axis 27 and defines a hole 28 (FIG. 6) adjacent top end 24. Below hole 28, each upright 12, 34 is formed with a slot 30 extending along axis 27 and a portion of upright 12, 34. Each slot 30 may be formed adjacent top end 24 and each hole 28 formed below each respective slot 30 without departing from the spirit of the present invention. Each upright 12, 34 preferably has a tapered bottom end 26 formed with an upwardly extending notch 32 which is radially symmetrical about axis 27. Each notch 32, which is a guide for marking where balusters should be installed, may be on a side of a respective upright 12, 34, as long as centered about axis 27. As an alternate for notches 32, bottom end 26 may include a marker line or have pointed ends, etc.

Figure 17:
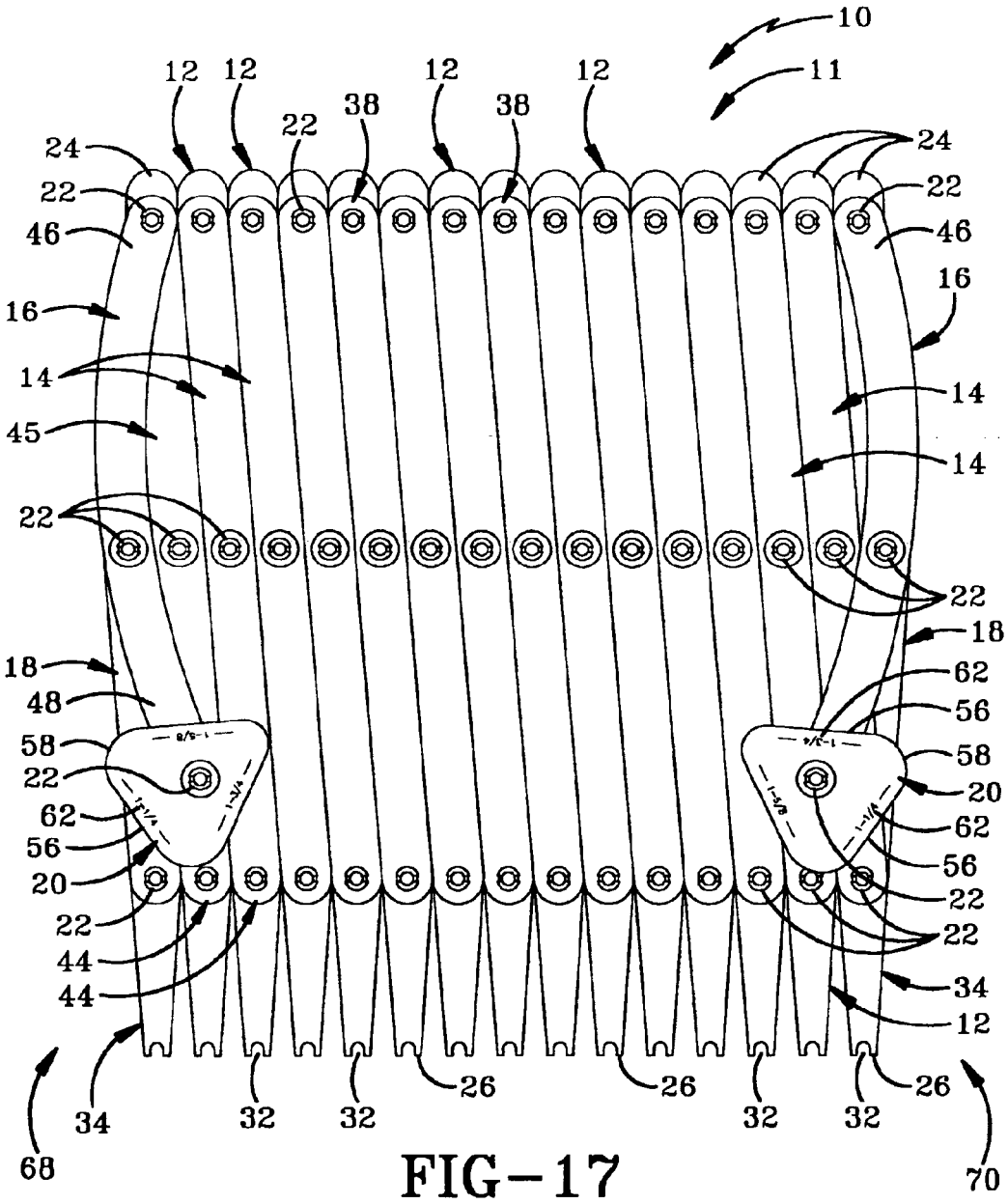
FIG. 17 is a side elevational view of the spacer tool in a folded configuration.

Each adjacent pair of uprights 12 and each upright 34 and its adjacent upright 12 defines equidistant spacing between respective central axes 27. This spacing varies as tool 10 moves between an open position (FIG. 1) and a closed position (FIG. 17). Terminal uprights 34 (FIG. 1) are interchangeable with interior uprights 12 and are only distinguished by their respective locations at first end 68 and second end 70 of tool 10 and their connection to arm 16, finger 18 and cross-bars 14 as described below.

Figure 9:
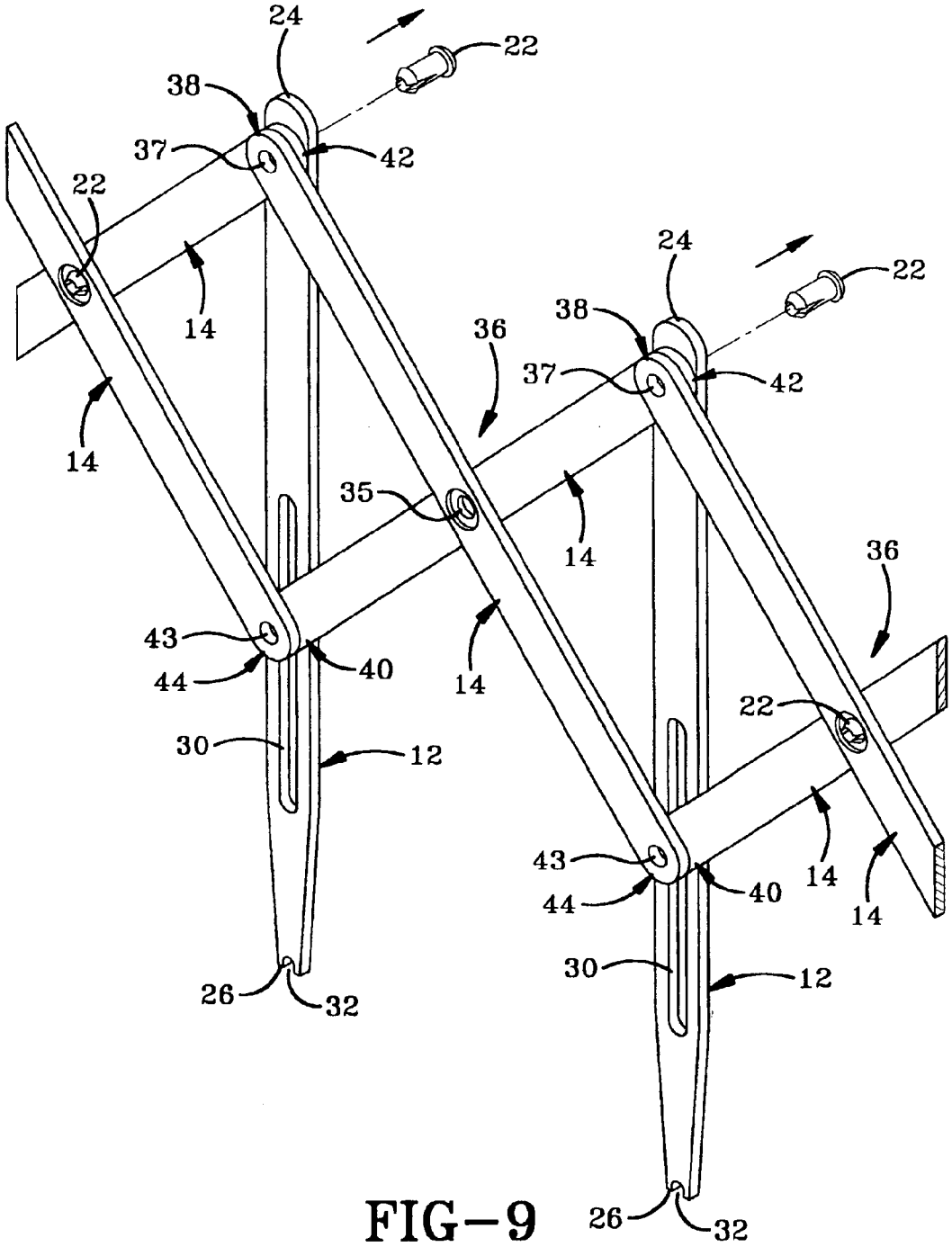
FIG. 9 is a fragmentary perspective view of the spacer tool similar to FIG. 3 showing some of the push rivets removed and some of the push rivets being removed.
Figure 10:
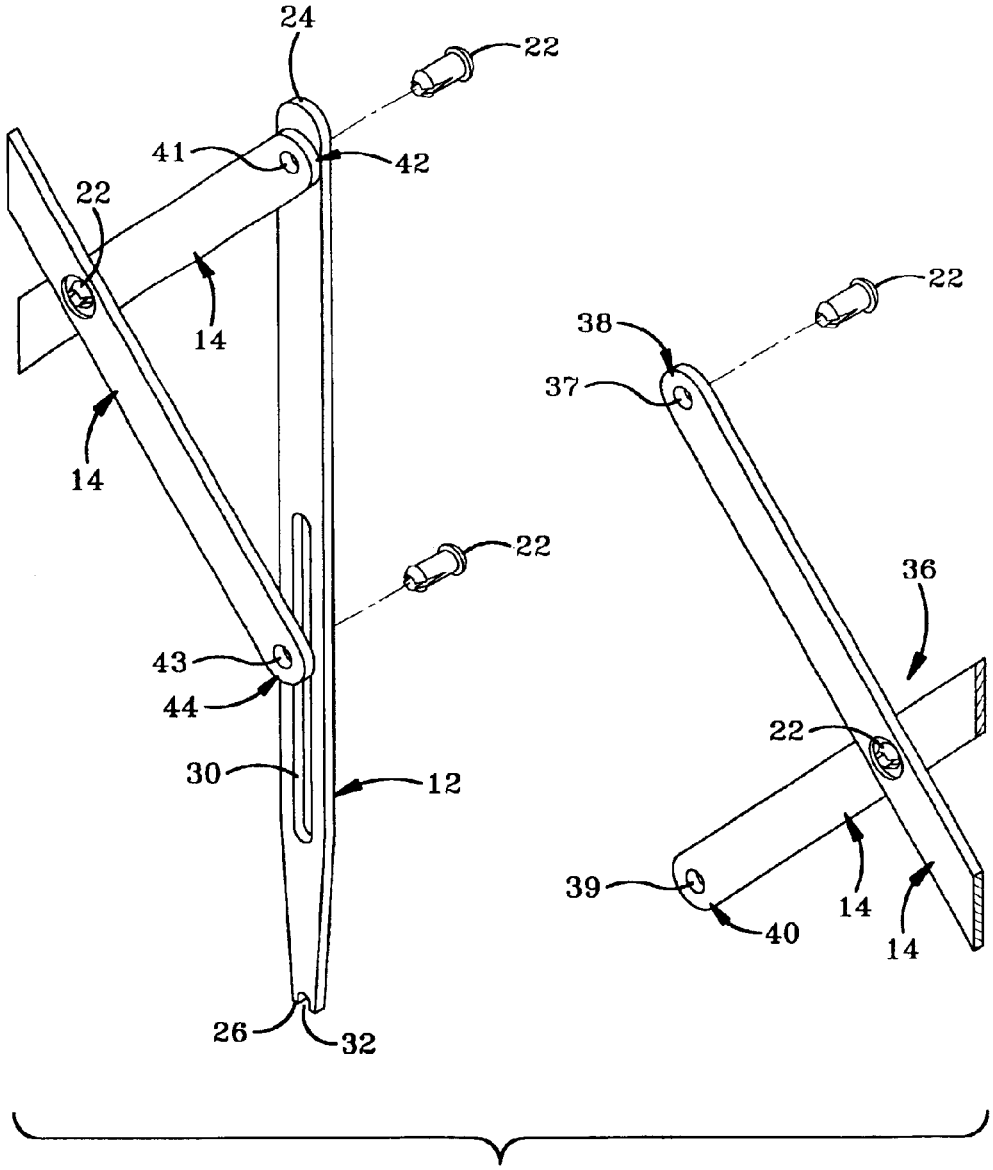
FIG. 10 is a fragmentary perspective view of the spacer tool after an upright and a pair of cross-bars has been removed.

All cross-bars 14 are substantially rigid and are interchangeable with one another. Each cross-bar 14 defines a hole 35 (FIG. 9) about a respective central transverse pivot axis 33. A push rivet 22 removably and pivotally connects a pair of cross-bars 14 at respective holes 35 to form an X-shaped set 36. Preferably, X-shaped sets 36 are all disposed on the same side of uprights 12, although they may be on opposite sides in an alternating fashion. Referring to FIG. 10, each set 36 has a first end 38, and defines a first hole 37 adjacent first end 38. Each set 36 has a second end 40 and defines a second hole 39 adjacent second end 40. Each set 36 has a third end 42 and defines a third hole 41 adjacent third end 42. Each set 36 has a fourth end 44 and defines a fourth hole 43 adjacent fourth end 44. Set 36 is removably pivotally connected at first hole 37 by a push rivet 22 to one upright 12, 34 at hole 28 thereof. Set 36 is removably pivotally and slidably connected at second hole 39 by a push rivet 22 to said one upright 12, 34 at slot 30. Set 36 is removably pivotally connected at third hole 41 by a push rivet 22 to an adjacent upright 12, 34 at hole 28 thereof. Set 36 is removably pivotally and slidably connected at fourth hole 43 by a push rivet 22 to said adjacent upright 12, 34 at the slot 30 thereof. Each X-shaped set 36 has a first side and a second side, the first side including the first and second holes 37 and 39 and the second side including the third and fourth holes 41 and 43. The distance from each of first, second, third and fourth holes 37, 39, 41 and 43 of X-shaped set 36 to medial pivot point 35 is the same, thus defining equal spacing between central axes 27 of each adjacent pair of uprights 12, 34 for any degree of extension of tool 10.

At each interior upright 12, a first set 36 lies adjacent a second set 36 (FIG. 8), where they overlap and are interconnected as follows. First set 36 is removably pivotally connected adjacent third end 42 at third hole 41 by a push rivet 22 to second set 36 adjacent first end 38 at first hole 37 thereof. Said rivet 22 further removably pivotally connects said third end 42 and said first end 38 to a common upright 12 at hole 28 thereof. First set 36 is also removably pivotally connected adjacent fourth end 44 at fourth hole 43 by a push rivet 22 to second set 36 adjacent second end 40 at second hole 39 thereof. Said push rivet 22 further removably pivotally and slidably connects said fourth end 44 and said second end 40 to said common upright 12 at slot 30 thereof.

Figure 3:
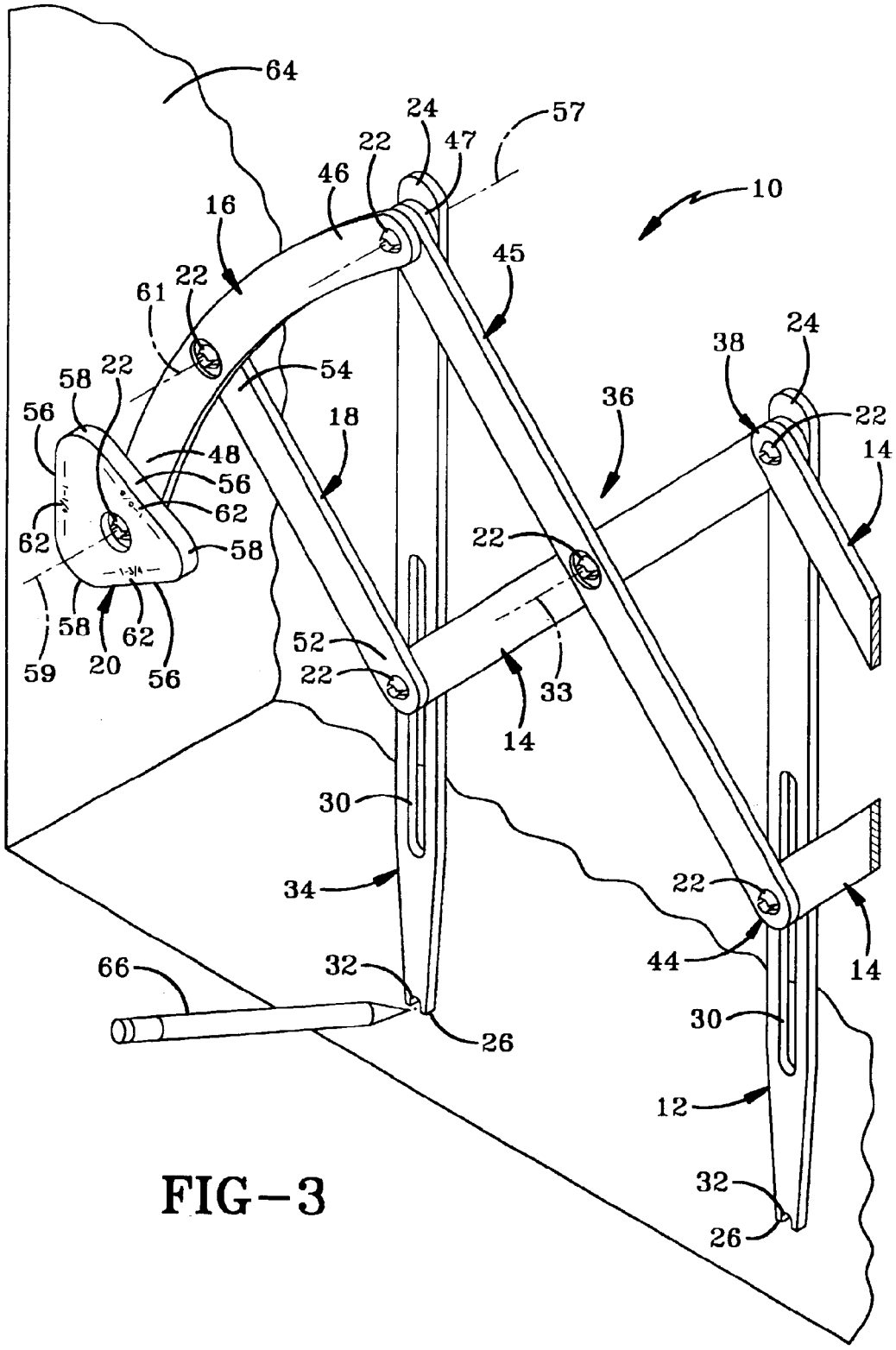
FIG. 3 is a fragmentary perspective view of the spacer tool of the present invention.
Figure 4:
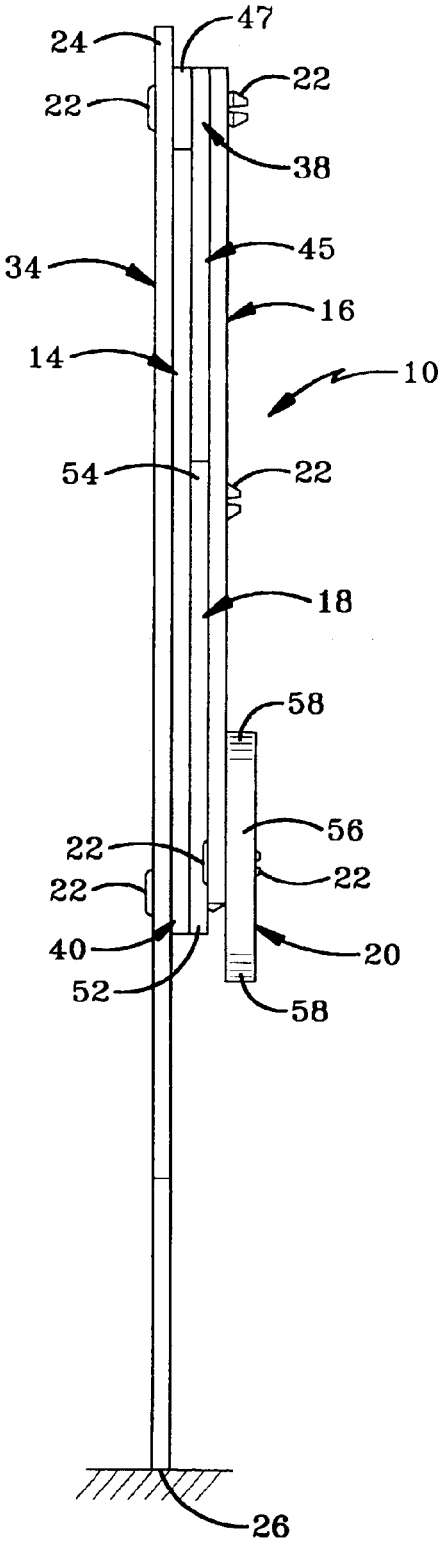
FIG. 4 is an end elevational view of the spacer tool looking in the direction of line 4—4, FIG. 2.
Figure 6:
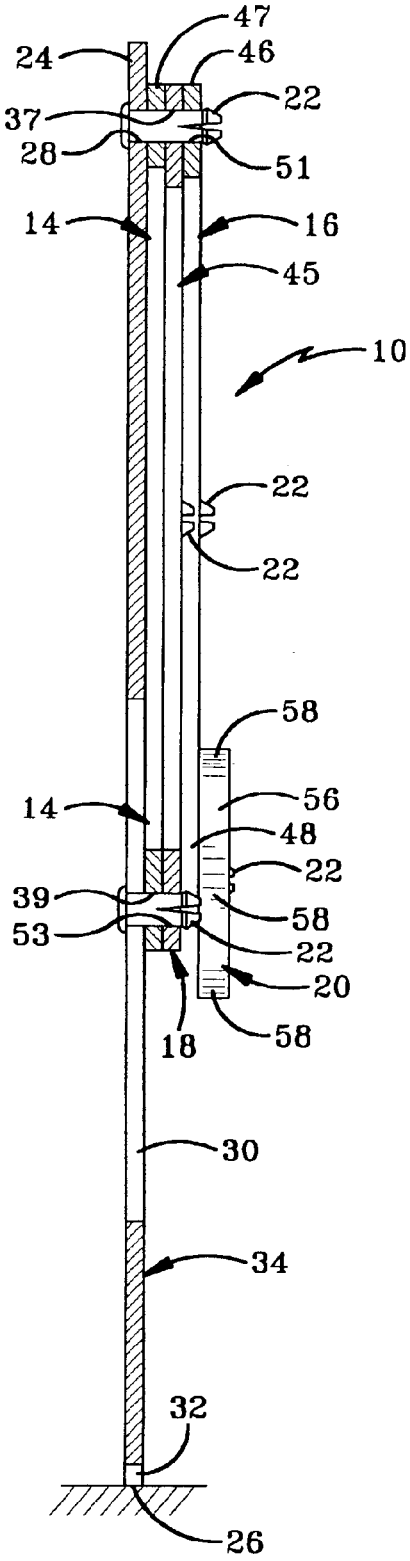
FIG. 6 is an enlarged sectional view of the spacer tool taken on line 6—6, FIG. 2.
Figure 5:
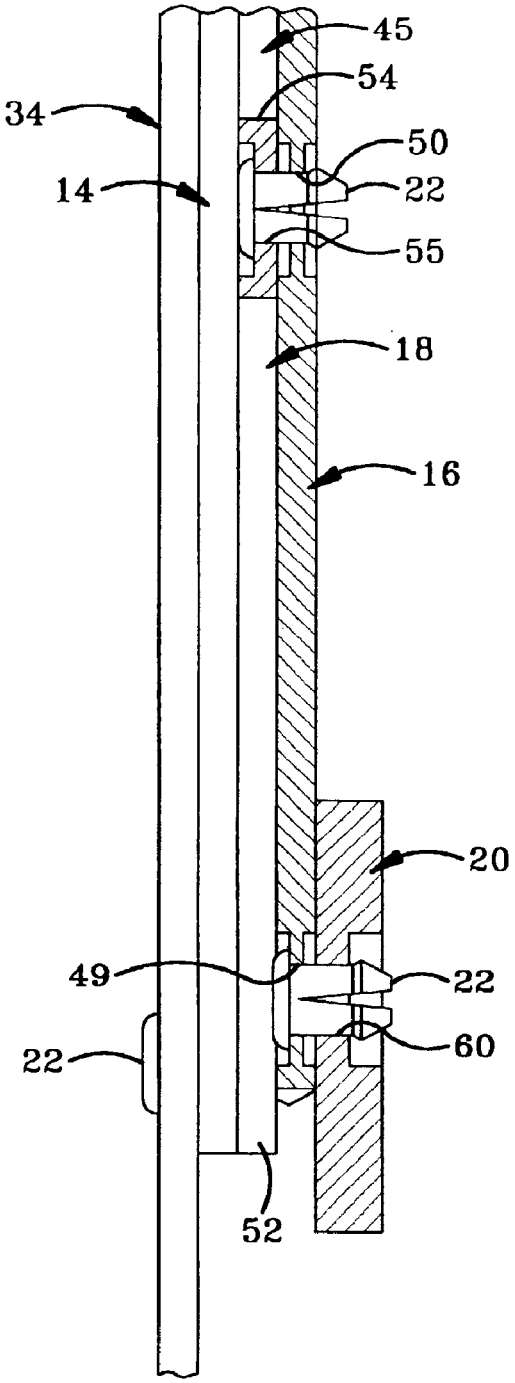
FIG. 5 is an enlarged fragmentary sectional view of the spacer tool taken on line 5—5, FIG. 2.
Figure 7:
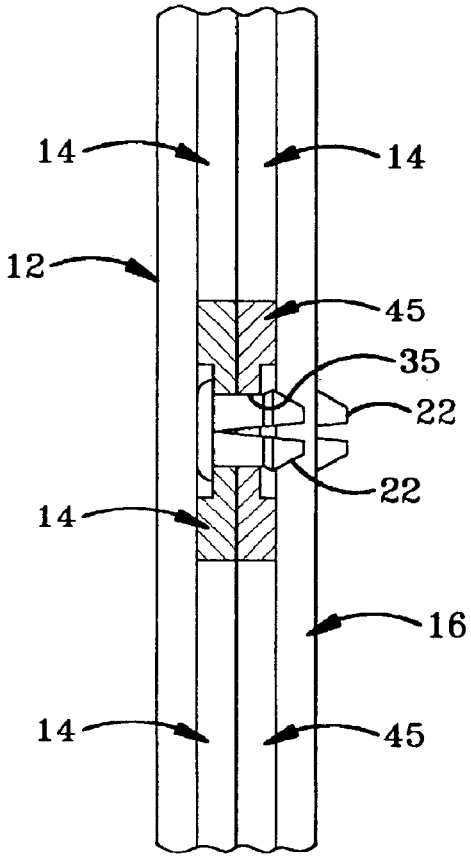
FIG. 7 is an enlarged fragmentary sectional view of the spacer tool taken on line 7—7, FIG. 2.

Cross-bars 14 include terminal cross-bar 45 adjacent first end 68 of tool 10. Cross-bar 45 is interchangeable with each cross-bar 14 and is only distinguished by its location as part of tool 10 and its connection to terminal upright 34 at hole 28 and to arm 16 at upper hole 51 (FIG. 6). Cross-bar 45 is pivotally connected to terminal upright 34 by a push rivet 22 with a spacing washer 47 (FIGS. 3–4) disposed between and pivotally connected to the two.

Each arm 16 is arcuate and defines an upper hole 51 (FIG. 6) about a transverse pivot axis 57 adjacent an upper end 46, a lower hole 49 (FIG. 5) about a transverse pivot axis 59 adjacent a lower end 48 and an intermediate hole 50 (FIG. 5) about a transverse pivot axis 61 intermediate upper and lower holes 51 and 49. Each transverse axis 57, 59 and 61 is perpendicular to the general plane along which tool 10 lies. The arcuate nature of each arm 16 defines a triangle between upper pivot axis 57, lower pivot axis 59 and intermediate pivot axis 61. Arms 16 may be straight, angled or otherwise configured as long as said pivot axes 49, 50 and 51 define a triangle. Each arm 16 is removably and pivotally connected at upper hole 51 by a push rivet 22 to one terminal upright 34 at the hole 28 thereof. One arm 16 is also removably and pivotally connected at upper hole 51 by said push rivet 22 to terminal cross-bar 45 adjacent first end 68 of tool 10. More specifically, as terminal cross-bar 45 is one cross-bar in an X-shaped set 36 and includes first hole 37 of set 36, the connection between arm 16 at hole 51 is at said first hole 37. Adjacent second end 70 of tool 10, the other arm 16 is removably and pivotally connected at upper hole 51 by a push rivet 22 to a cross-bar 14 at third hole 41 thereof. Each arm 16 extends outwardly and downwardly from a respective end 68 or 70 of tool 10. Arms 16 are substantially rigid and are interchangeable with one another.

Each finger 18 has an inner end 52 and an outer end 54 (FIG. 4) and defines an inner hole 53 (FIG. 6) adjacent inner end 52 and an outer hole 55 (FIG. 5) adjacent outer end 54. The distance between inner pivot point 53 and outer pivot point 55 of finger 18 equals the distance between the central pivot point 35 of cross-bars 14 and any one of pivot points 37, 39, 41 or 43 of X-shaped set 36. Each finger 18 is removably pivotally connected at outer hole 55 by a push rivet 22 to arm 16 at intermediate hole 50 thereof. Adjacent first end 68 of tool 10, one finger 18 is removably pivotally connected by a push rivet 22 to an X-shaped set 36 at second hole 39 thereof. Said one finger 18 is also removably pivotally and slidably connected at inner hole 53 by said push rivet 22 to a respective terminal upright 34 at slot 30 thereof. Adjacent second end 70 of tool 10, the other finger 18 is removably pivotally connected by a push rivet 22 to an X-shaped set 36 at fourth hole 43 thereof, and is removably pivotally and slidably connected to a respective terminal upright 34 at slot 30 thereof by said push rivet 22. Each finger 18 extends outwardly and upwardly from a respective end 68 or 70 of tool 10. Fingers 18 are substantially rigid and are interchangeable with one another. Arm 16 and finger 18 may switch places without departing from the spirit of the invention such that arm 16 extends outwardly and upwardly and finger 18 extends outwardly and downwardly from respective end 68 or 70 of tool 10.

In addition, adjacent second end 70 of tool 10, two spacing washers (not shown) lie adjacent arm 16. More specifically, one spacing washer (not shown) is disposed between finger 18 at outer hole 55 thereof and arm 16 at intermediate hole 50 thereof. A push rivet 22 pivotally connects arm 16, finger 18 and said one spacing washer at said holes 50 and 55. The other spacing washer (not shown) is disposed between cross-bar 14 at third hole 41 thereof (said cross-bar 14 being attached to terminal upright 34) and arm 16 at upper hole 51 thereof. A push rivet 22 pivotally connects arm 16, finger 18 and said other spacing washer at said holes 41 and 51. When tool 10 is in the closed position (FIG. 17), this pair of spacing washers allow arm 16 adjacent second end 70 to overlap the cross-bars 14 that lie farthest from uprights 12 and 34.

Figure 13:
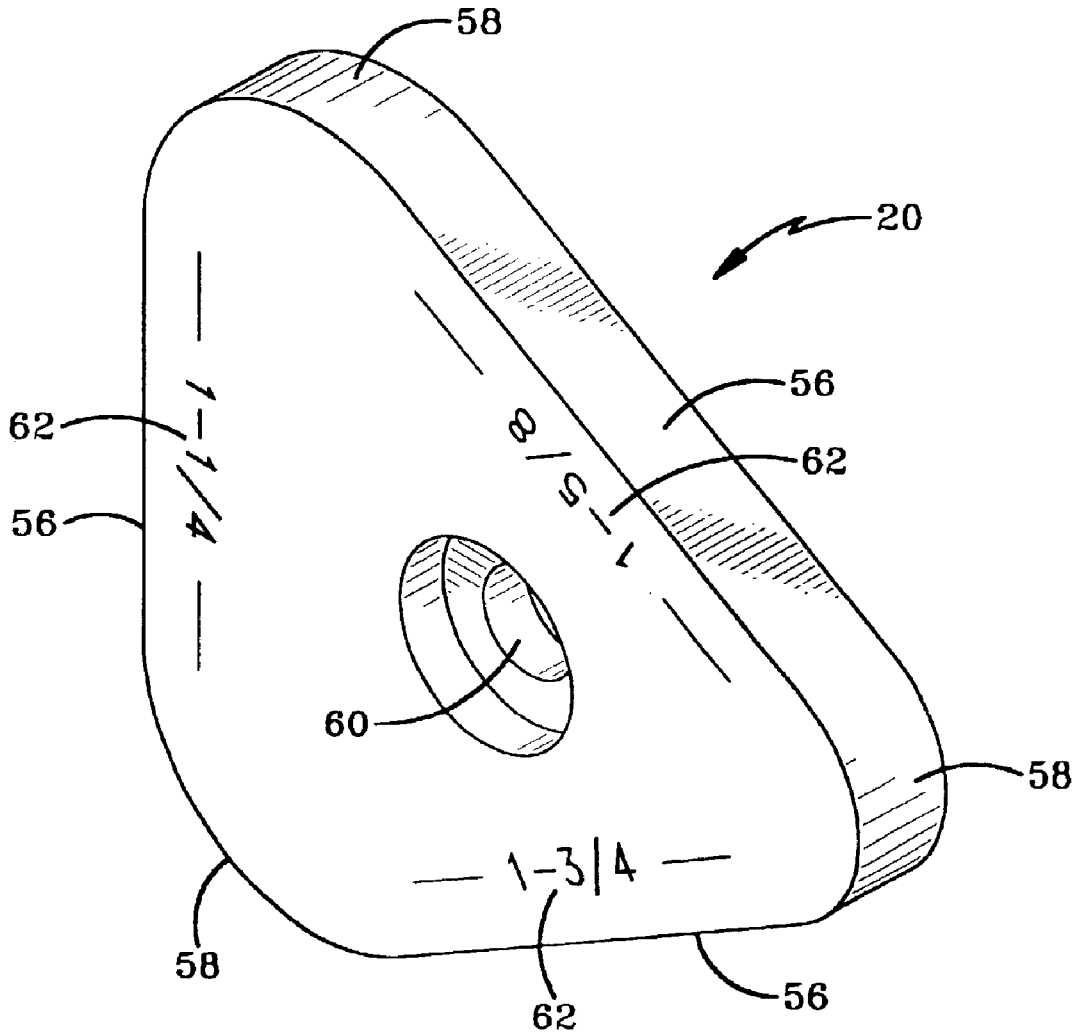
FIG. 13 is an enlarged perspective view of the cam of the spacer tool showing three sides marked for use with different size balusters.

Each cam 20 (FIG. 13) is generally triangular with three flat sides 56 and rounded corners 58, although the shape and number of sides may vary. Cam 20 defines a hole 60 (FIG. 5) at which cam 20 is removably pivotally connected by a push rivet 22 to arm 16 at lower hole 49 thereof. Hole 60 is concentric about pivot axis 59 when cam 20 is connected to arm 16 and each side 56 of cam 20 is a different distance from pivot axis 59. Cam 20 includes labels 62 adjacent respective sides 56. The three sides 56 of cam 20 have labels of "1¼", "1⅝" and "1¾", respectively, more fully explained below. The distance between pivot axis 59 and side 56 with label "1¼" adjacent thereto is larger than the distance between pivot axis 59 and side 56 with label "1⅝" adjacent thereto, which is in turn larger than the distance between pivot axis 59 and side 56 with label "1¾" adjacent thereto.

Cams 20 are substantially rigid and are interchangeable with one another. However, each pair of cams 20 may be replaced with alternate pairs of cams having different dimensions from cams 20 but wherein each cam of the alternate pair is the same as the other. Other configurations may be used to serve in place of cam 20. For instance, below lower hole 49, arm 16 may have a selectively positionable hinge or sliding piece connected thereto to provide the adjustability that cam 20 preferably provides.

Tool 10 includes five layers adjacent first end 68 of tool 10 and five layers adjacent second end 70, although the make-up of the layers is somewhat different (FIGS. 4–7) at either end. Throughout tool 10, one layer is made up of uprights 12 and 34. The adjacent layer is made up of the cross-bars 14 that are one half of each X-shaped set 36, along with spacing washer 47 adjacent first end 68 and finger 18 adjacent second end 70 of tool 10. The next layer is made up of the cross-bars 14 that are the other half of each X-shaped set 36, said next layer adjacent first end 68 including finger 18 and adjacent second end 70 including the two spacing washers (not shown) that are disposed respectively between arm 16 and each of finger 18 and the cross-bar 14 which is attached to terminal upright 34 at hole 28 thereof. The next adjacent layer is made up of arm 16 adjacent first end 68 and arm 16 adjacent second end 70. The final layer is made up of cams 20.

In operation, tool 10 extends and retracts like a pantograph. This motion is allowed by the pivotal connections between the various parts as described above, as well as the slidable nature of the connection between cross-bars 14 and uprights 12 as push rivets 22 slide back and forth within slots 30. This extension and retraction allows uprights 12 to be spaced as desired. Because uprights 12 remain parallel at all stages of extension, the spacing between each adjacent pair of uprights 12 (and between upright 12 and terminal upright 34) is equidistant, while the extension and retraction of tool 10 allows the spacing to vary. Notches 32 of uprights 12 create guides for marking, as with a pencil 66 (FIG. 3) where balusters or the like are to be installed.

Figure 8:
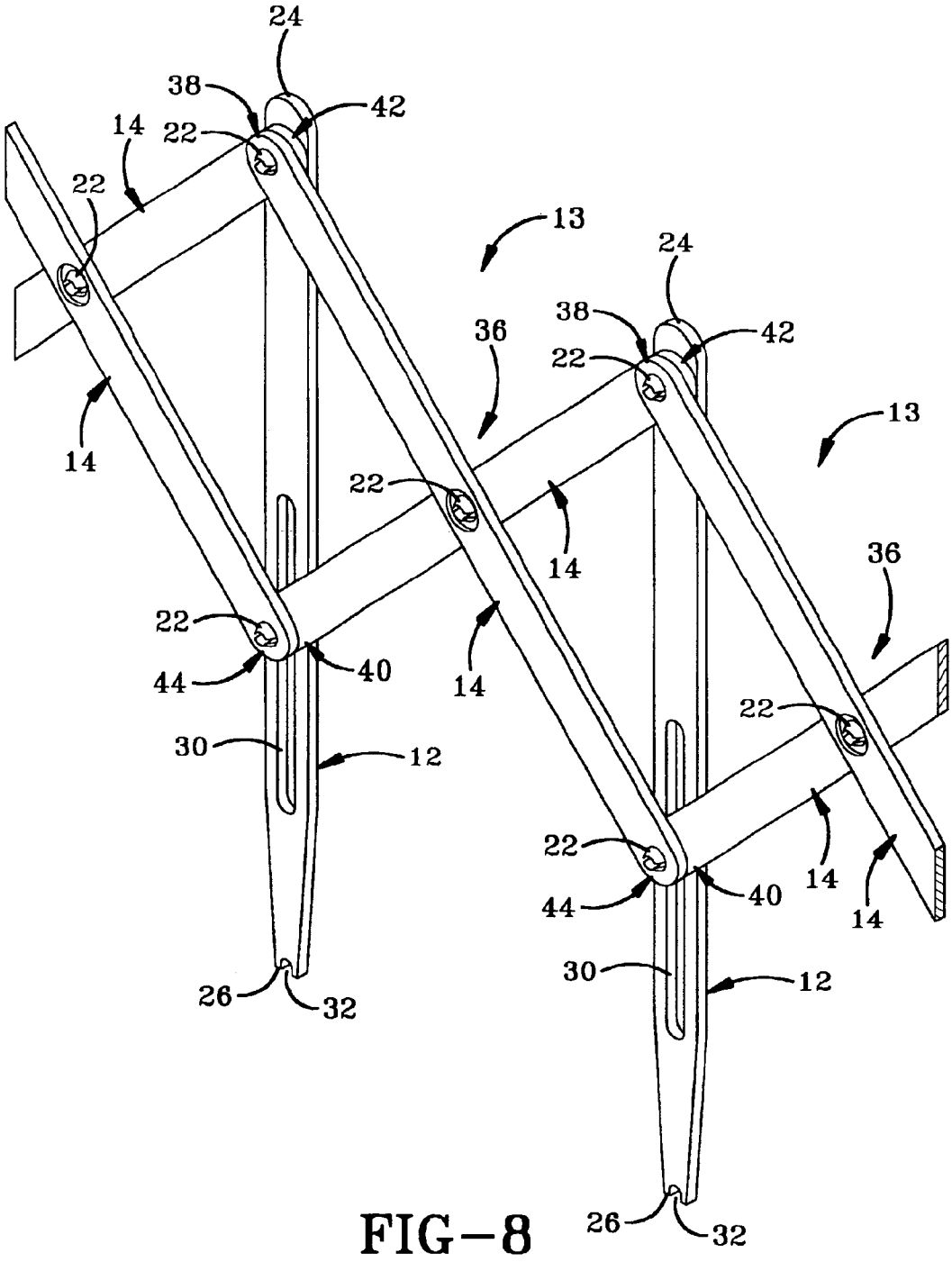
FIG. 8 is a fragmentary perspective view of the spacer tool.
Figure 11:
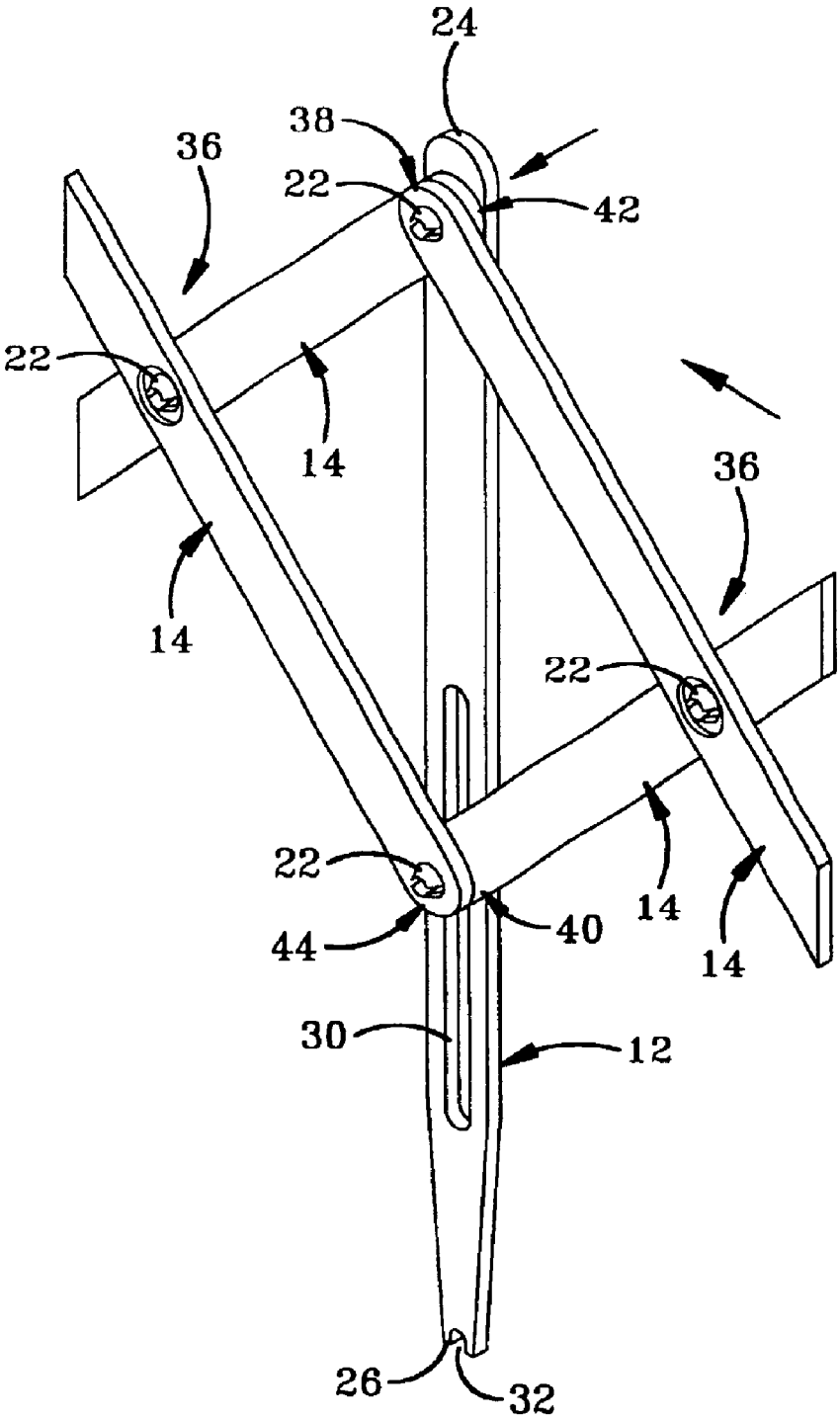
FIG. 11 is an fragmentary perspective view of the spacer tool showing the connection of portions of the spacer tool to form a reduced-length configuration.

In accordance with the invention, the removable connections of tool 10 allow it to be shortened or lengthened to give tool 10 great versatility. To shorten the overall length of tool 10, push rivets 22 can be removed wherever necessary to allow removal of cross-bars 14 and uprights 12 (FIGS. 8–9). The push rivet 22 that connects each pair of cross-bars 14 at medial pivot points 35 to form an X-shaped set 36 need not be removed to shorten tool 10, as set 36 can remain intact during this process. Specifically, portions of tool 10 each made up of an upright 12 and a set 36 may be removed by removing the four push rivets 22 which connect a set 36 to two adjacent uprights. Removal of push rivets 22 and the portion or portions made up of set 36 and upright 12 leaves two separate sections of tool 10 along with a disconnected upright 12. These remaining two sections of tool 10 are then rejoined by appropriately aligning an upright 12 and cross-bars 14 of the respective remaining sections and inserting push rivets 22 at the appropriate holes and slots (FIGS. 10–11). Likewise, this concept may be applied in removing the rivets 22 associated with terminal upright 34. In that case, one of the remaining sections would include arm 16, finger 18 and cam 20. Thus, reassembly would involve reconnecting arm 16 and finger 18 to a terminal upright 34 at hole 28 and slot 30 thereof, respectively.

As noted above, each X-shaped set 36 has a first side and a second side, the first side including the first and second holes 37 and 39 and the second side including the third and fourth holes 41 and 43. In an alternate embodiment (not shown), X-shaped sets 36 are alternately disposed on one side of uprights 12 and the other side of uprights 12 and are thus not connected to one another, but only to uprights 12 and 34. In this alternate embodiment, only one side of each X-shaped set 36 need be removably connected to a respective upright 12, 34 in order to remove a section to shorten the spacer tool. Said section comprises an upright 12, 34 connected to an X-shaped set 36. Such a removable connection also allows for the lengthening of the spacer tool.

Tool 10 can be lengthened by removing the two push rivets 22 that connect a single upright 12 to the four corresponding cross-bars 14, providing additional cross-bars 14 and uprights 12 as desired and connecting them as described above with additional push rivets 22. Again, this concept may be applied in removing the two push rivets 22 that connect a terminal upright 34 to the two corresponding cross-bars 14 and 45, arm 16 and finger 18. Thus, reassembly would involve connecting arm 16 and finger 18 to an inserted terminal upright-34. Because the lengthening and shortening of tool 10 involves in part the addition or removal of uprights 12, the number of uprights 12 used between two surfaces 64 may be controlled, allowing for a wide range in the number of balusters to be used between said surfaces 64 and also the spacing therebetween.

The removable nature of the connections between the various parts of tool 10 as described herein also allows for the replacement of any damaged parts along with cost savings associated therewith. The interchangeable nature of uprights 12 with one another and of cross-bars 14 with one another simplifies their replacement and reduces the cost of production of tool 10. This is also true of arms 16, fingers 18, and cams 20. Many of push rivets 22 are also interchangeable, as previously noted, which thus also simplifies the lengthening and shortening of tool 10 and the replacement of damaged parts.

In accordance with the invention, each arm 16 and corresponding finger 18 and cam 20 are configured to adjustably set the spacing between central axis 27 of terminal upright 34 and surface 64 so that said spacing is in a preferred relation to the spacing between the axes 27 of each adjacent pair of uprights 12 as tool 10 is extended or retracted. The preferred spacing relationship is defined below. The triangle defined by upper pivot axis 57, lower pivot axis 59 and intermediate pivot axis 61 of arm 16, in conjunction with finger 18 being connected at hole 50 about intermediate axis 61, allows for such relative spacing to be properly set. This configuration allows the spacing between lower pivot point 49 (and via cam 20, between surface 64) and axis 27 of terminal upright 34 to change at different rates than the spacing between the axes 27 of each adjacent pair of uprights 12 as tool 10 is extended or retracted.

The preferred spacing between axis 27 of upright 34 and surface 64 is the 20 difference between the spacing between a pair of adjacent axes 27 and one half the width of a baluster (not shown) to be installed, wherein the baluster is part of a set of balusters each having the same width. The three flat sides 56 of cam 20 are configured to establish the correct spacing between axis 27 and upright 34 and between each adjacent pair of uprights 12 (or between uprights 12 and 34) when using a set of balusters each having a width of 1¼ inches, 1⅝ inches or 1¾ inches, respectively, as indicated by corresponding labels 62 on cam 20. Thus, when 1¼-inch-wide balusters are to be used, side 56 of cam 20 which has a corresponding label 62 for "1¼" is placed against surface 64. Likewise, respective sides 56 are placed against surface 64 for balusters having widths of 1⅝ inches or 1¾ inches.

Figure 14:
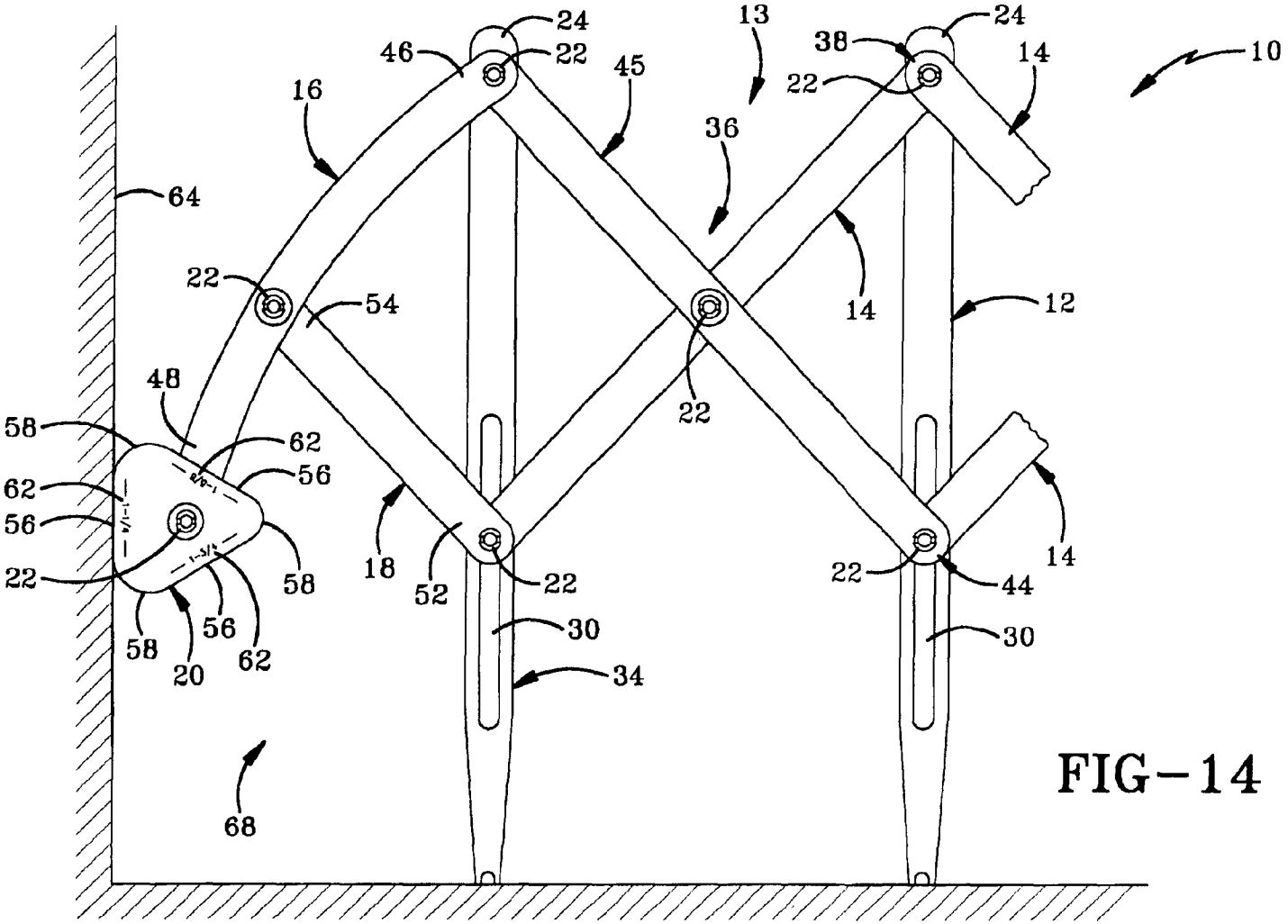
FIG. 14 is a fragmentary side elevational view of the spacer tool showing the cam positioned for use with 1¼-inch balusters.
Figure 15:
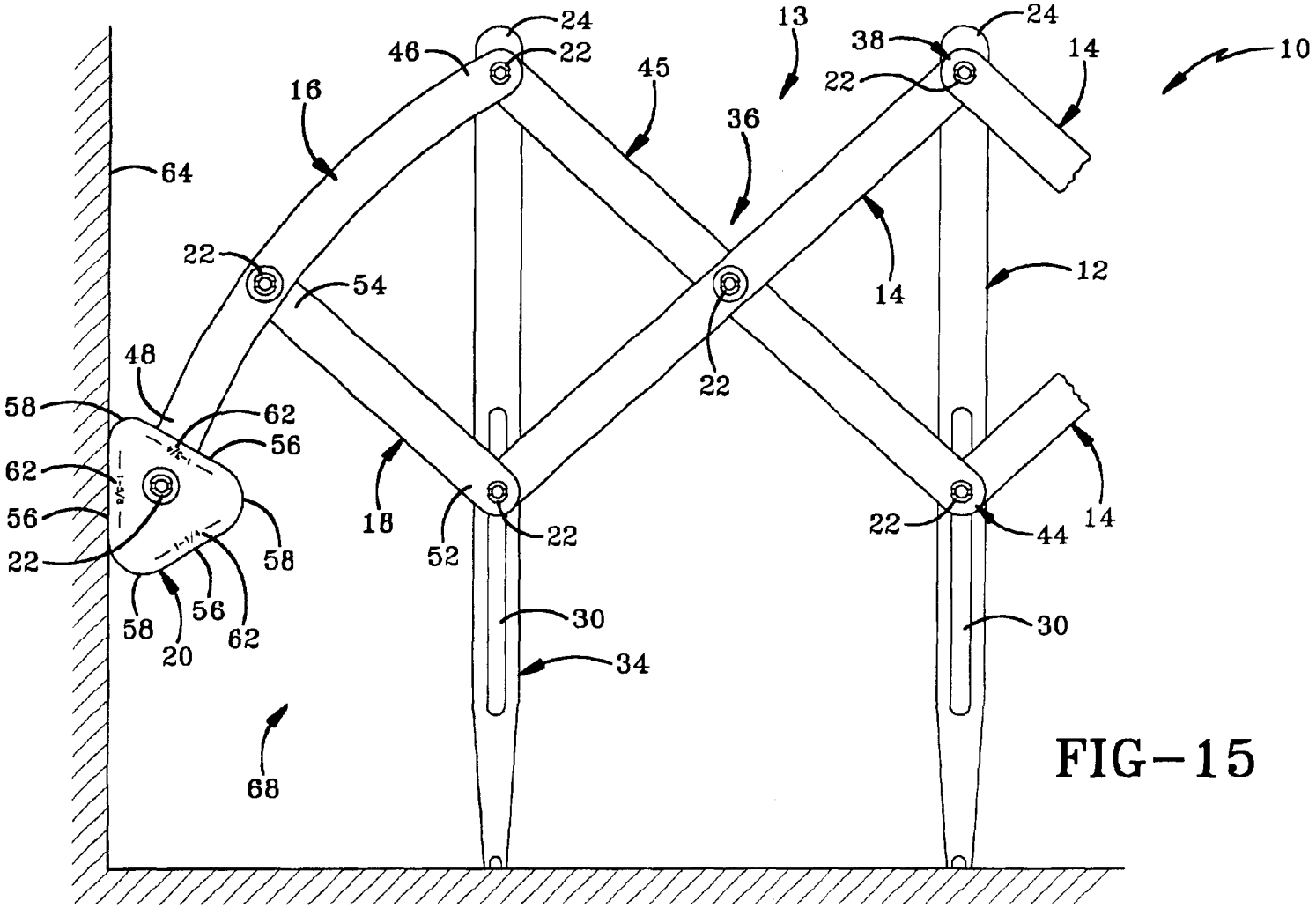
FIG. 15 is a fragmentary side elevational view of the spacer tool showing the cam positioned for use with 1⅝-inch balusters.
Figure 16:
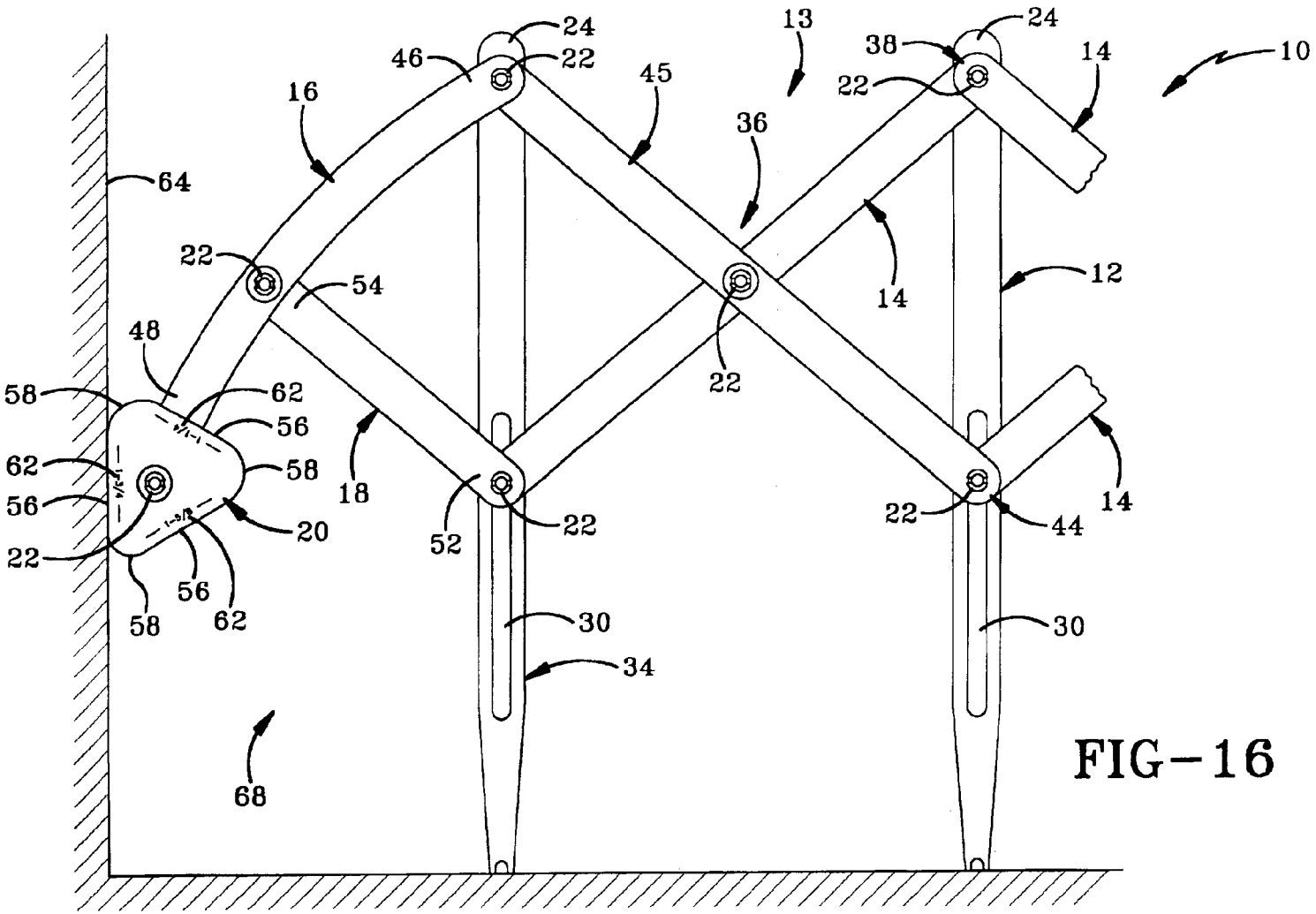
FIG. 16 is a fragmentary side elevational view of the spacer tool showing the cam positioned for use with 1¾-inch balusters.

Thus, as the different sides 56 of cam 20 are disposed against surface 64, different spacing is established between axis 27 of upright 34 and surface 64 and also between each adjacent pair of uprights 12 and between adjacent uprights 12 and 34. As noted above, the distance between pivot axis 59 and side 56 with label "1¼" adjacent thereto is larger than the distance between pivot axis 59 and side 56 with label "1⅝" adjacent thereto, which is in turn larger than the distance between pivot axis 59 and side 56 with label "1¾" adjacent thereto. Thus, for a given number of uprights 12 and 34, and for a given distance between two surfaces 64, with each cam 20 disposed against a respective surface 64, the spacing between axis 27 of upright 34 and surface 64 and also between each adjacent pair of uprights 12 (or 12 and 34) increases as the width of the balusters increases (FIGS. 14–16). Cams 20 may be configured with different dimensions for different sets of same-width balusters other than those enumerated herein, and because cams 20 are removably connected to arm 16, replacement of cams 20 with cams having different configurations adds to the versatility of tool 10.

Where it is desired that balusters or the like be installed in a scenario where only one surface 64 is involved, such as a handrail that extends from a wall and is free-standing at one end, tool 10 may be used with only one arm 16, one finger 18 and one cam 20 because the spacing between axis 27 and upright 34 can thereby be established on one end of tool 10. In addition, the spacing between axis 27 of upright 34 and surface 64 and between uprights 12, 34 may be established without the use of cam 20 where lower end 48 of arm 16 is configured to be disposed against surface 64 to set said spacing. However, using arm 16 without cam 20 limits the ability to set said spacing to only one set of same-width balusters. Cam 20 helps quickly establish said spacing for various sets of same-width balusters by rotating cam 20 about pivot axis 59.

Figure 18:
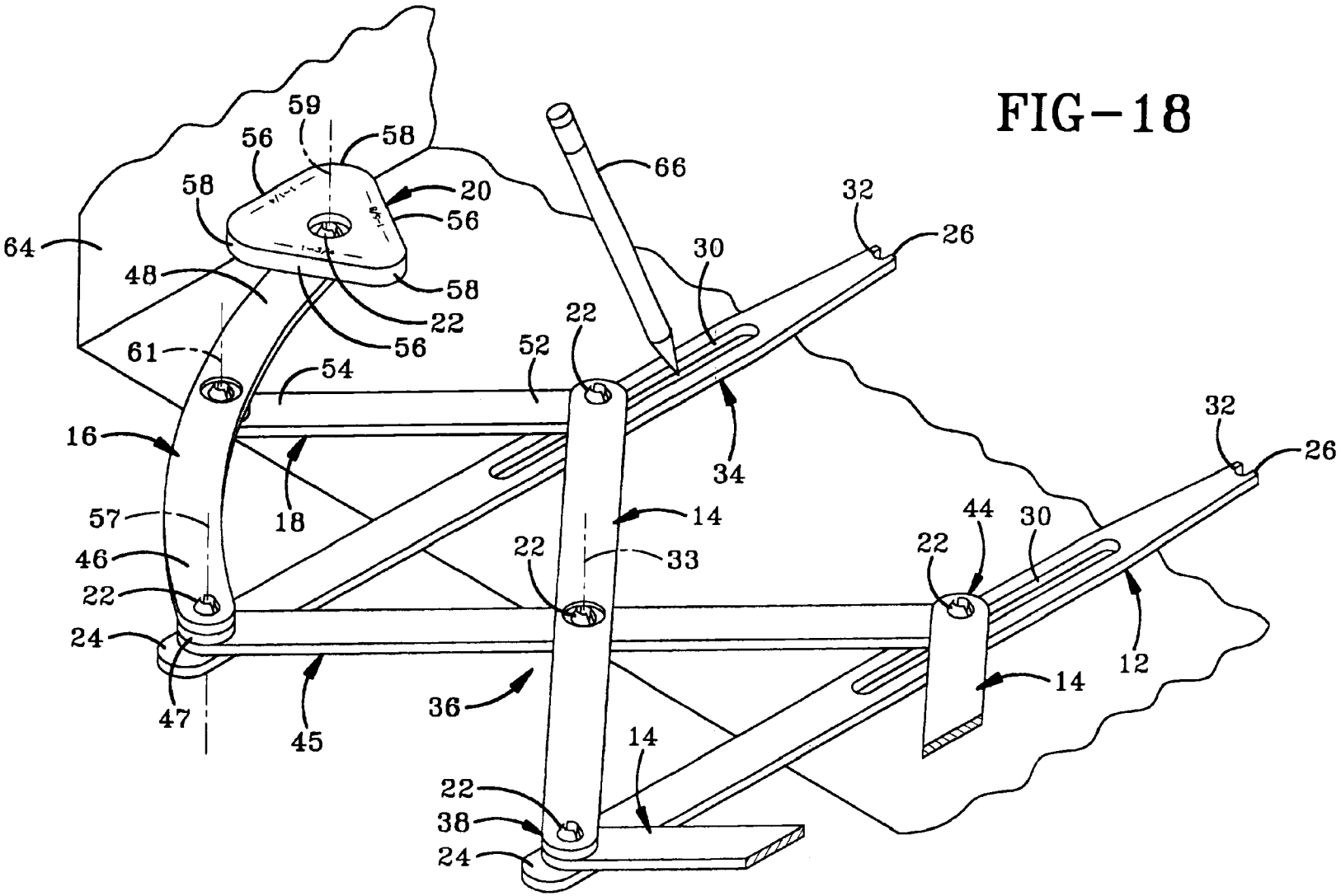
FIG. 18 is a top plan view of the spacer tool as used in a horizontal position.

Spacer tool 10 may be, and often is, used in a horizontal or laying down position, as shown in FIG. 18. Generally, tool 10 is used in the same manner as described above, except that the user preferably uses slots 30 in respective uprights 12 as guides for marking the locations for the balusters, as with pencil 66. Notches 32 may still be used for marking when tool 10 is in the horizontal position, but slots 30 are generally better aligned between cams 20 and thus present a straight line or nearly a straight between surfaces 64 from which the markings are measured.

Other embodiments of the spacer tool may have some connections that are removable and some that are not, in various combinations. For example, a spacer tool may have removable connections only between each upright 12 and the first and second ends 38 and 40 of the X-shaped set 36 connected thereto. This configuration allows the spacer tool to be shortened or lengthened in sections comprising an X-shaped set 36 and an upright 12 non-removably connected thereto. Other possibilities include, but are not limited to, only cams 20 being removable or only arms 16 and fingers 18 being removable, which would allow for the replacement of those parts with identical or different parts.

An alternate embodiment uses a straight arm 16, or more specifically, an arm 16 wherein axes 57, 59 and 61 of arm 16 are collinear. In this configuration, the spacing provided between surface 64 and axis 27 of terminal upright 34 is not defined by the above formula for the preferred embodiment. That is, said spacing is not the difference between the spacing between a pair of adjacent axes 27 and one half the width of a baluster which is part of a set of same-width balusters. However, this collinear-axis configuration does provide spacing between surface 64 and axis 27 of upright 34 which follows a different formula and which may also be desirable.

In the foregoing description, certain terms have been used for brevity, clearness and understanding, but no unnecessary limitations are to be implied therefrom beyond the requirement of the prior art, because such terms are used for descriptive purposes and are intended to be broadly construed. Moreover, the description and illustration of the invention is by way of example, and the scope of the invention is not limited to the exact details shown or described.

Having now described the features, discoveries and principles of the invention, the manner in which the improved spacer tool is constructed and used, the characteristics of the construction, and the advantageous, new and useful results obtained; the new and useful structures, devices, elements, arrangements, parts and combinations are set forth in the appended claims.

What is claimed is:

1. A spacer tool comprising:

an extendable pantographic assembly having a first end and a second end opposed thereto; the pantographic assembly for setting equidistant spacing between a plurality of respective adjacent marking guides along the length of the assembly;

a first arm having first and second opposed ends and being pivotally connected to the first end of the assembly at a first pivot axis which is adjacent the first end of the first arm and common to the first arm and the first end of the assembly; the second end of the arm projecting from the first pivot axis away from the second end of the assembly;

a first finger pivotally connected to the arm at a second pivot axis which is common to the finger and arm and disposed intermediate the first and second ends of the arm; the second pivot axis being disposed distal the first end of the assembly in a direction away from the second end of the assembly; the first finger being pivotally connected to the first end of the assembly at a third pivot axis common to the finger and first end of the assembly; and the first arm and first finger for setting the spacing between the first end of the assembly and a first surface; the first arm and first finger being configured to allow the spacing between the first end of the assembly and the first surface to change at a different rate than the equidistant spacing along the length of the assembly when the assembly is extended or retracted.

2. The tool as defined in claim 1 wherein the assembly includes uprights and cross-bars and the uprights are removably connected to the cross-bars to allow replacement of uprights and the lengthening and shortening of the spacer tool.

3. The tool as defined in claim 2 wherein the uprights are interchangeable with one another to facilitate replacement of uprights and the lengthening and shortening of the spacer tool.

4. The tool as defined in claim 3 wherein the cross-bars are removably connected to one another to allow replacement of cross-bars.

5. The tool as defined in claim 4 wherein the cross-bars are interchangeable with one another to facilitate replacement of cross-bars.

6. The tool as defined in claim 1 wherein the arm is arcuate to allow the spacing between the first end of the assembly and the first surface to change at the different rate.

7. The tool as defined in claim 1 further including a second arm and a second finger;

the second arm having first and second opposed ends and being pivotally connected to the second end of the assembly at a third pivot axis which is adjacent the first end of the second arm and common to the second arm and the second end of the assembly; the second end of the second arm projecting from the third pivot axis away from the first end of the assembly;

the second finger pivotally connected to the second arm at a fourth pivot axis which is common to the second finger and second arm and disposed intermediate the first and second ends of the arm: the fourth pivot axis being disposed distal the second end of the assembly in a direction away from the first end of the assembly; the second finger being pivotally connected to the second end of the assembly at a fifth pivot axis common to the second finger and second end of the assembly; and the second arm and second finger for setting the spacing between the second end of the assembly and a second surface the second arm and second finger being configured to allow the spacing between the second end of the assembly and the second surface to change at a different rate than the equidistant spacing along the length of the assembly when the assembly is extended or retracted.

8. The tool as defined in claim 7 wherein the assembly includes uprights and cross-bars and the uprights are removably connected to the cross-bars to allow replacement of uprights and to allow the lengthening and shortening of the spacer tool to fit between the first and second surfaces and provide desired spacing therebetween.

9. The tool of claim 1 wherein the pantographic assembly includes a plurality of elongated uprights each defining an elongated slot extending in the elongated direction of the upright; wherein the uprights include a terminal upright adjacent the first end of the assembly; and wherein one of the arm and the finger is pivotally and slidably connected to the terminal upright via a pivot member slidably received within the slot defined by the terminal upright.

10. The tool of claim 9 wherein the slots serve as guides for marking installation locations.

11. The tool of claim 1 wherein an adjustment mechanism is movably connected to the arm adjacent the second end thereof; and wherein said adjustment mechanism is selectively positionable to set the spacing between the first end of the assembly and the first surface for different widths of respective same-width sets of balusters.

12. The tool of claim 1 wherein the spacing between the first end of the assembly and the first surface is set when the second end of the arm is in contact with the first surface.

13. The tool of claim 1 wherein the pantographic assembly includes a plurality of uprights having first and second opposed ends; wherein the pantographic assembly includes a plurality of X-shaped sets of cross-bars, each X-shaped set comprising a pair of cross-bars pivotally and medially connected to one another; wherein each X-shaped set has a first side and a second side; wherein one of each pair of cross-bars is pivotally connected adjacent the first side of a respective X-shaped set to one of the uprights adjacent the first end thereof and is pivotally and slidably connected adjacent the second side of the respective X-shaped set to another of the uprights adjacent the second end thereof; and wherein the other of each pair of cross-bars is pivotally connected adjacent the second side of the respective X-shaped set to the another of the uprights adjacent the first end thereof and is pivotally and slidably connected adjacent the first side of the respective X-shaped set to the one of the uprights adjacent the second end thereof.

14. The tool of claim 1 wherein a cam is pivotally connected to the second end of the arm and is adapted to correspond to different widths of respective same-width sets of balusters for setting the spacing between the first end of the assembly and the first surface.

15. The tool of claim 1 wherein one of the arm at the first pivot axis and the finger at the third pivot axis is slidably connected to the pantographic assembly.

16. The tool of claim 1 wherein a transverse axis passes through the arm adjacent the second end thereof; and wherein the transverse axis and the first and second pivot axes define a triangle.

17. The tool of claim 16 wherein a cam is pivotally connected to the arm at the transverse axis.

18. The tool of claim 1 wherein the pantographic assembly includes a plurality of X-shaped sets each including a pair of cross-bars pivotally and medially connected to one another at a central axis.

19. The tool of claim 18 wherein the plurality of X-shaped sets includes first and second terminal X-shaped sets;

wherein each X-shaped set has first, second, third and fourth ends;

wherein the first and second ends of each X-shaped set except the first terminal X-shaped set are pivotally connected respectively to the third and fourth ends of an adjacent X-shaped set;

wherein the third and fourth ends of each X-shaped set except the second terminal X-shaped set are pivotally connected respectively to the first and second ends of an adjacent X-shaped set;

the equidistant spacing between respective adjacent marking locations being associated with the second and fourth ends of each X-shaped set;

wherein the first end of the first terminal X-shaped set is pivotally connected respectively to one of the arm at the first pivot axis and the finger at the third pivot axis;

wherein the second end of the first terminal X-shaped set is pivotally connected respectively to the other of the arm at the first pivot axis and the finger at the third pivot axis;

and wherein the spacing between the first end of the assembly and the first surface is associated with spacing between the marking guide nearest the second end of the first terminal X-shaped set and the second end of the finger.

20. The tool of claim 19 wherein the spacing between the first end of the assembly and the first surface is set when the second end of the finger is adjacent the first surface.

21. The tool of claim 19 wherein the third end of the second terminal X-shaped set is pivotally connected respectively to one of a second arm and a second finger; and wherein the fourth end of the second terminal X-shaped set is pivotally connected respectively to the other of the second arm and second finger; the second arm and second finger for setting the spacing between the second end of the assembly and a second surface; the second arm and second finger being configured to allow the spacing between the second end of the assembly and the second surface to change at a different rate than the equidistant spacing along the length of the assembly when the assembly is extended or retracted.

22. A spacer tool comprising:

an extendable pantographic assembly having a first end and a second end and being adapted to set the spacing along the length of the assembly between a plurality of same-width balusters to be installed;

a first arm projecting from and pivotally connected to the first end of the assembly; and having an end distal the first end of the assembly;

a first finger pivotally connected to the arm and pivotally and slidably connected to the first end of the assembly;

the first arm and first finger being adapted to set the spacing between the first end of the assembly and a first surface from which the balusters are to be spaced; and a cam pivotally connected to the arm adjacent said distal end; said cam being adapted to correspond to different widths of respective same-width sets of balusters for setting the spacing between the first end of the assembly and the surface.

23. The tool as defined in claim 22 wherein the cam is removably connected to the arm to allow replacement of the cam.

24. The tool of claim 22 wherein the cam is pivotally connected to the arm about a pivot axis; and wherein the cam has a plurality of sides each spaded from the axis a radial distance which differs from the radial distance of each other side; and wherein each side is adapted to correspond to a different width of a respective same-width set of balusters for setting the spacing between the first end of the assembly and the first surface.

25. The tool of claim 24 wherein the cam has three sides.

26. The tool of claim 25 wherein a first one of the three sides corresponds to a set of balusters each having a width of 1¼ inches; wherein a second one of the three sides corresponds to a set of balusters each having a width of 1⅝ inches; and wherein a third one of the three sides corresponds to a set of balusters each having a width of 1¾ inches.

27. A spacer tool comprising:

an extendable pantographic assembly having a first end and a second end opposed thereto; the pantographic assembly for setting equidistant spacing between a plurality of respective adjacent marking guides along the length of the assembly:

an arm having a first end, a second end, a first pivot axis adjacent the first end of the arm, a second pivot axis adjacent the second end of the arm and an intermediate pivot axis intermediate the first and second pivot axes; each of the pivot axes passing through the arm; the arm pivotally connected about the first pivot axis to one end of the assembly; the first, second and intermediate axes defining a triangle;

a finger pivotally connected to the arm at the intermediate axis thereof and pivotally connected to the one end of the assembly; and the arm and finger being adapted to set the spacing between the one end of the assembly and a surface from which the balusters are to be spaced.

28. The tool as defined in claim 27 wherein the assembly includes uprights and cross-bars and the uprights are removably connected to the cross-bars to allow replacement of uprights and lengthening and shortening of the spacer tool.

29. The tool as defined in claim 28 wherein the uprights are interchangeable with one another to facilitate replacement of uprights and lengthening and shortening of the spacer tool.

30. The tool as defined in claim 29 wherein the cross-bars are removably connected to one another to allow replacement of cross-bars.

31. The tool as defined in claim 30 wherein the cross-bars are interchangeable with one another to facilitate replacement of cross-bars.

32. The tool as defined in claim 27 in which the arm is removably connected to said one end of the assembly and to the finger to allow replacement of the arm; and the finger is removably connected to said one end of the assembly to allow replacement of the finger.

33. The tool as defined in claim 27 wherein the spacing set between the end of the assembly and the surface is the difference between the spacing set by a pair of adjacent uprights and one half the width of one of the same-width balusters.

34. The tool as defined in claim 27 wherein the spacing set by the spacer tool is such that the distance between each adjacent pair of balusters equals the distance between the surface and the baluster adjacent the surface when the balusters are installed.

35. The tool as defined in claim 27 wherein the arm is arcuate.

36. The tool of claim 27 wherein one of the arm and the finger is slidably connected to the one end of the assembly.

37. A spacer tool comprising:

an extendable pantographic assembly having a first end and a second end and being adapted to set the spacing along the length of the assembly between a plurality of same-width balusters to be installed;

an arm having a first end, a second end, a first pivot axis adjacent the first end of the arm, a second pivot axis adjacent the second end of the arm and an intermediate pivot axis intermediate the first and second pivot axes; the arm pivotally connected about the first pivot axis to one end of the assembly; the first, second and intermediate axes defining a triangle;

a finger pivotally connected to the arm at the intermediate axis thereof and pivotally and slidably connected to the one end of the assembly;

the arm and finger being adapted to set the spacing between the one end of the assembly and a surface from which the balusters are to be spaced; and a cam being pivotally connected to the arm about the second pivot axis thereof; said cam being adapted to correspond to different widths of a same-width set of balusters in setting the spacing between the one end of the assembly and the surface.

38. The tool as defined in claim 37 wherein the cam is removably connected to the arm to allow replacement of the cam.

39. The tool of claim 37 wherein the cam is pivotally connected to the arm about a pivot axis; and wherein the cam has a plurality of sides each spaced from the axis a radial distance which differs from the radial distance of each other side; and wherein each side is adapted to correspond to a different width of a respective same-width set of balusters for setting the spacing between the first end of the assembly and the first surface.

40. The tool of claim 39 wherein the cam has three sides.

41. The tool of claim 40 wherein a first one of the three sides corresponds to a set of balusters each having a width of 1¼ inches; wherein a second one of the three sides corresponds to a set of balusters each having a width of 1⅝ inches; and wherein a third one of the three sides corresponds to a set: of balusters each having a width of 1¾ inches.

42. A method of installing balusters comprising the steps of:

providing an adjustable spacer tool including an extendable pantographic assembly having, a first end and a second end opposed thereto; the pantographic assembly for setting equidistant spacing between a plurality of respective adjacent marking guides along the length of the assembly; a first arm having first and second opposed ends and being pivotally connected to the first end of the assembly at a first pivot axis which is adjacent the first end of the first arm and common to the first arm and the first end of the assembly; the second end of the arm projecting from the first pivot axis away from the second end of the assembly; a first finger pivotally connected to the arm at a second pivot axis which is common to the finger and arm and disposed intermediate the first and second ends of the arm; the second pivot axis being disposed distal the first end of the assembly in a direction away from the second end of the assembly; the first finger being pivotally connected to the first end of the assembly at a third pivot axis common to the finger and first end of the assembly; and the first arm and first finger for setting the spacing between the first end of the assembly and a first surface; the first arm and first finger being configured to allow the spacing between the first end of the assembly and the first surface to change at a different rate than the equidistant spacing along the length of the assembly when the assembly, is extended or retracted;

placing the arm against a surface from which the balusters are to be spaced;

adjusting the spacing and length of the spacer tool by at least one of extending and retracting the spacer tool; and marking installation locations corresponding to at least two of the adjacent marking guides.

43. The method as defined in claim 42 further including the step of installing the balusters at the installation locations.

44. The method of claim 42 wherein the spacer tool further includes a plurality of uprights which define the respective marking guides and a plurality of X-shaped sets of cross-bars, each X-shaped set comprising a pair of cross-bars being pivotally and medially connected to one another; each X-shaped set having a first side and a second side connected to respective uprights; one side of each X-shaped set being removably connected to the respective upright; and the method further including the steps of:

removing at least one section of the spacer tool so as to leave a pair of remaining portions of the spacer tool, said at least one section comprising an upright and an X-shaped set of cross-bars; and connecting the remaining portions so as to shorten the spacer tool.

45. The method of claim 42 wherein the spacer tool further includes a plurality of uprights which define the respective marking guides and at least one X-shaped set of cross-bars, each X-shaped set comprising a pair of cross-bars being pivotally and medially connected to one another; each X-shaped set having a first side and a second side connected to respective uprights; one side of each X-shaped set being removably connected to the respective upright; and the method further including the steps of:

disconnecting an upright from an X-shaped set of cross-bars; and adding at least one section to the spacer tool so as to lengthen the spacer tool, said at least one section comprising an upright and an X-shaped set of cross-bars.

46. A method of installing balusters comprising the steps of:

providing an adjustable spacer tool including an extendable pantographic assembly having a plurality of uprights, a first end and a second end; the assembly being adapted to set the spacing along the length of the assembly between a plurality of same-width balusters to be installed; a first arm projecting from and pivotally connected to the first end of the assembly; a first finger pivotally connected to the arm and pivotally and slidably connected to the first end of the assembly; the first arm having an end distal the first end of the assembly; a first cam pivotally connected to the arm adjacent the distal end of the first arm; the first cam having sides that correspond to different widths of respective sets of same-width balusters; the first arm, first finger and first cam being adapted to set the spacing between the first end of the assembly and a first surface from which the balusters are to be spaced;

measuring the width of the balusters;

turning the first cam so that the side of the first cam that corresponds to the width of the balusters to be installed is facing outwardly from the first end of the assembly;

placing the corresponding side of the first cam against the first surface;

adjusting the spacing and length of the spacer tool by at least one of extending and retracting the spacer tool; and marking baluster installation locations corresponding to at least two of the uprights.

47. The method as defined in claim 46 further including the step of installing the balusters at the installation locations.

48. The method of claim 46 wherein the spacer tool further includes a second arm projecting from and pivotally connected to the second end of the assembly; a second finger pivotally connected to the second arm and pivotally and slidably connected to the second end of the assembly; the second arm having an end distal the second end of the assembly; a second cam pivotally connected to the second arm adjacent the distal end of the second arm; the second cam having sides that correspond to the different widths of the respective sets of same-width balusters; the second arm, second finger and second cam being adapted to set the spacing between the second end of the assembly and a second surface; and wherein the method further includes the steps of:

turning the second cam so that the side of the second cam that corresponds to the width of the balusters to be installed is facing outwardly from the second end of the assembly; and placing the corresponding side of the second cam against the second surface.

49. The method of claim 48 wherein the spacer tool further includes a plurality of X-shaped sets of cross-bars, each X-shaped set comprising a pair of cross-bars being pivotally and medially connected to one another; each X-shaped set having a first side and a second side connected to respective uprights; one side of each X-shaped set being removably connected to the respective upright; and the method further including the steps of:

removing at least one section of the spacer tool so as to leave a pair of remaining portions of the spacer tool, said at least one section comprising an upright and an X-shaped set of cross-bars; and connecting the remaining portions so as to shorten the spacer tool.

50. The method of claim 48 wherein the spacer tool further includes at least one X-shaped sets of cross-bars, each X-shaped set comprising a pair of cross-bars being pivotally and medially connected to one another; each X-shaped set having a first side and a second side connected to respective uprights; one side of each X-shaped set being removably connected to the respective upright; and the method further including the steps of:

disconnecting an upright from an X-shaped set of cross-bars; and adding at least one section to the spacer tool so as to lengthen the spacer tool, said at least one section comprising an upright and an X-shaped set of cross-bars.

51. The method of claim 46 wherein the arm has a first end opposed to the distal end thereof, a first pivot axis adjacent the first end of the arm, a second pivot axis adjacent the distal end of the arm and an intermediate pivot axis intermediate the first and second pivot axes; wherein each of the pivot axes passes through the arm; wherein the arm is pivotally connected about the first pivot axis to the first end of the assembly; wherein the finger is pivotally connected to the arm at the intermediate axis thereof; and wherein the first, second and intermediate axes define a triangle.

* * * * *